US012061011B2

(12) United States Patent
Welch

(10) Patent No.: US 12,061,011 B2
(45) Date of Patent: Aug. 13, 2024

(54) CLIMATE-CONTROL SYSTEM WITH SENSIBLE AND LATENT COOLING

(71) Applicant: Copeland LP, Sidney, OH (US)

(72) Inventor: Andrew M. Welch, Franklin, OH (US)

(73) Assignee: Copeland LP, Sidney, OH (US)

( * ) Notice: Subject to any disclaimer, the term of this patent is extended or adjusted under 35 U.S.C. 154(b) by 139 days.

(21) Appl. No.: 17/346,007

(22) Filed: Jun. 11, 2021

(65) Prior Publication Data

US 2022/0397291 A1 Dec. 15, 2022

(51) Int. Cl.
*F24F 5/00* (2006.01)
*F24F 3/14* (2006.01)
*F24F 11/77* (2018.01)

(52) U.S. Cl.
CPC ..... *F24F 5/001* (2013.01); *F24F 3/1405* (2013.01); *F24F 11/77* (2018.01)

(58) Field of Classification Search
CPC ..... F25B 5/02; F25B 2400/0409; F25B 2700/2104; F25B 2700/21; F25B 2700/02;

(Continued)

(56) References Cited

U.S. PATENT DOCUMENTS

RE21,510 E * 7/1940 Smith ..... F24F 5/001 62/226
3,103,796 A * 9/1963 Dickson ..... F25D 21/06 62/275

(Continued)

FOREIGN PATENT DOCUMENTS

EP 2992272 A1 3/2016
JP 2002235933 A 8/2002

(Continued)

OTHER PUBLICATIONS

International Search Report regarding Application No. PCT/US2022/030334 dated Sep. 2, 2022.

(Continued)

*Primary Examiner* — Tavia Sullens
(74) *Attorney, Agent, or Firm* — Harness, Dickey & Pierce, P.L.C.

(57) ABSTRACT

A climate-control system may include a vapor-compression circuit and an air handler assembly. The vapor-compression circuit may include a compressor, an outdoor heat exchanger, and first and second working-fluid-fluid flow paths. The first and second working-fluid-flow paths are in fluid communication with the outdoor heat exchanger. The first working-fluid-flow path may include a first expansion device and a first indoor heat exchanger. The second working-fluid-flow path may include a second expansion device and a second indoor heat exchanger. The first and second indoor heat exchangers are disposed within the air handler assembly. The air handler assembly includes a return-air-inlet duct, first and second airflow paths, and a supply-air-outlet duct. The first airflow path may receive air from the return-air-inlet duct and houses the first indoor heat exchanger. The second airflow path may receive air from the return-air-inlet duct. The supply-air-outlet duct receives air from the first and second airflow paths.

16 Claims, 4 Drawing Sheets

(58) Field of Classification Search
CPC ..... F25B 2313/0314; F25B 2313/0315; F25B 2313/0316; F24F 12/006; F24F 5/001; F24F 2012/007; F24F 3/1405; F24F 2110/10; F24F 2110/12; F24F 2110/20; F24F 2110/22; F24F 11/77; F24F 11/84
See application file for complete search history.

(56) References Cited

U.S. PATENT DOCUMENTS

| | | | | |
|---|---|---|---|---|
| 4,207,754 | A | 6/1980 | Chaboseau et al. | |
| 4,295,518 | A | 10/1981 | Rannenberg | |
| RE31,281 | E | 6/1983 | Swenson et al. | |
| 4,445,639 | A | 5/1984 | Kinsell et al. | |
| 4,535,606 | A | 8/1985 | Rannenberg | |
| 5,031,413 | A * | 7/1991 | Tsuihiji | F25B 5/02 62/282 |
| 5,121,610 | A | 6/1992 | Atkinson et al. | |
| 5,462,110 | A | 10/1995 | Sarver | |
| 5,628,203 | A | 5/1997 | Adolph et al. | |
| 6,041,615 | A | 3/2000 | Ostersetzer et al. | |
| 6,301,922 | B1 | 10/2001 | Ochi | |
| 6,360,557 | B1 | 3/2002 | Reznik | |
| 6,619,064 | B1 | 9/2003 | Piao et al. | |
| 6,966,198 | B2 | 11/2005 | Piccirilli et al. | |
| 7,124,594 | B2 | 10/2006 | McRell | |
| 7,654,307 | B2 | 2/2010 | Bhatti et al. | |
| 7,827,812 | B2 | 11/2010 | Yabu et al. | |
| 7,886,556 | B2 | 2/2011 | Fujiyoshi et al. | |
| 8,439,277 | B2 | 5/2013 | Phillips | |
| 8,769,969 | B2 | 7/2014 | DeMonte et al. | |
| 8,936,071 | B2 | 1/2015 | Bruno et al. | |
| 9,188,359 | B2 | 11/2015 | Ishimoto et al. | |
| 9,777,941 | B2 | 10/2017 | Grimaldi et al. | |
| 9,885,486 | B2 | 2/2018 | Wintemute | |
| 9,970,698 | B2 | 5/2018 | Gomes et al. | |
| 10,488,059 | B2 | 11/2019 | Phillips | |
| 10,557,643 | B2 | 2/2020 | Nelson | |
| 10,707,800 | B2 | 7/2020 | Wu et al. | |
| 11,090,605 | B2 | 8/2021 | Moghaddam | |
| 11,326,795 | B2 | 5/2022 | Phillips | |
| 11,371,728 | B2 | 6/2022 | Goel et al. | |
| 2002/0164944 | A1 | 11/2002 | Haglid | |
| 2004/0089000 | A1 | 5/2004 | Christen et al. | |
| 2005/0023362 | A1 | 2/2005 | Wacker | |
| 2006/0236715 | A1 | 10/2006 | Nikai et al. | |
| 2007/0137238 | A1 * | 6/2007 | Hu | F25B 5/02 62/277 |
| 2011/0100043 | A1 | 5/2011 | Matubara et al. | |
| 2012/0064818 | A1 | 3/2012 | Kurelowech | |
| 2012/0291463 | A1 * | 11/2012 | O'Brien | F24F 12/006 62/126 |
| 2016/0265805 | A1 | 9/2016 | Landry | |
| 2018/0252487 | A1 | 9/2018 | Wintemute et al. | |
| 2018/0328603 | A1 | 11/2018 | Lee et al. | |
| 2020/0130849 | A1 | 4/2020 | Henning et al. | |
| 2020/0173671 | A1 | 6/2020 | Rowe et al. | |
| 2020/0215870 | A1 | 7/2020 | Androulakis et al. | |
| 2020/0236820 | A1 | 7/2020 | Meadows et al. | |
| 2020/0240693 | A1 | 7/2020 | Khalili et al. | |
| 2020/0271354 | A1 | 8/2020 | Jayarathne | |
| 2021/0188448 | A1 | 6/2021 | Retersdorf | |
| 2022/0099313 | A1 | 3/2022 | Dean | |

FOREIGN PATENT DOCUMENTS

| | | | |
|---|---|---|---|
| KR | 101118167 | B1 | 3/2012 |
| WO | WO-2020116551 | A1 | 6/2020 |
| WO | 2022248995 | A1 | 12/2022 |

OTHER PUBLICATIONS

Written Opinion of the ISA regarding Application No. PCT/US2022/030334 dated Sep. 2, 2022.
Separate sensible and latent cooling systems: A critical review of the state-of-the-art and future prospects, Nawaz et al., 2018.
Ch. 26 Air-to-Air Recovery Equipment, 2020 ASHRAE Handbook—HVAC Systems and Equipment (SI).
Air cycle refrigeration—Food Refrigeration & Process Engineering Research Centre, The Grimsby Institute of Further & Higher Education, https://grimsby.ac.uk/documents/frperc/research/aircycle_research.pdf (At least as early as May 6, 2022).
Lesson 9, Air cycle refrigeration systems, Version 1 ME, IIT Kharagpur (Jan. 2018).

* cited by examiner

CLIMATE-CONTROL SYSTEM WITH SENSIBLE AND LATENT COOLING

FIELD

The present disclosure relates to a climate-control system with sensible cooling and latent cooling.

BACKGROUND

This section provides background information related to the present disclosure and is not necessarily prior art.

Conventional vapor-compression systems are often used to cool a space and reduce humidity within the space. While such systems have generally been effective means to cool a space and reduce humidity, there is a need for a system that provides more efficient and more customized sensible and latent cooling over a wider range of outdoor weather conditions. The present disclosure provides such a system for providing more customized and efficient sensible and latent cooling in the space.

SUMMARY

This section provides a general summary of the disclosure, and is not a comprehensive disclosure of its full scope or all of its features.

In one form, the present disclosure provides a climate-control system that includes a vapor-compression circuit and an air handler assembly. The vapor-compression circuit may include a compressor, an outdoor heat exchanger, a first working-fluid-fluid flow path and a second working-fluid-flow path. The compressor is configured to circulate a working fluid through the vapor-compression circuit. The outdoor heat exchanger is in fluid communication with the compressor. The first working-fluid-flow path is in fluid communication with the outdoor heat exchanger. The first working-fluid-flow path may include a first expansion device and a first indoor heat exchanger. The second working-fluid-flow path is in fluid communication with the outdoor heat exchanger. The second working-fluid-flow path may include a second expansion device and a second indoor heat exchanger. The first and second indoor heat exchangers may be disposed within the air handler assembly. The air handler assembly may include a return-air-inlet duct, a first airflow path, a second airflow path, and a supply-air-outlet duct. The first airflow path may receive air from the return-air-inlet duct and may house the first indoor heat exchanger. The second airflow path may receive air from the return-air-inlet duct. The supply-air-outlet duct may receive air from the first and second airflow paths.

In some configurations of the climate-control system of the above paragraph, air flows through the first indoor heat exchanger in the first airflow path, and air that enters the supply-air-outlet duct from the second airflow path will have passed through the second indoor heat exchanger without flowing through the first indoor heat exchanger.

In some configurations of the climate-control system of either of the above paragraphs, the second airflow path bypasses the first airflow path.

In some configurations of the climate-control system of any of the above paragraphs, the second indoor heat exchanger is disposed in the second airflow path.

In some configurations of the climate-control system of any of the above paragraphs, the second indoor heat exchanger is disposed upstream of the first and second airflow paths.

In some configurations of the climate-control system of any of the above paragraphs, the first airflow path receives air that has passed through the second indoor heat exchanger.

In some configurations of the climate-control system of any of the above paragraphs, the second airflow path includes a damper that controls airflow through the second airflow path.

In some configurations of the climate-control system of any of the above paragraphs, the first airflow path includes an air-to-air heat exchanger.

In some configurations of the climate-control system of any of the above paragraphs, the air-to-air heat exchanger includes a duct upstream of the first indoor heat exchanger and another duct downstream of the first indoor heat exchanger. Heat is transferred between the air in the ducts.

In some configurations of the climate-control system of any of the above paragraphs, the air handler assembly includes a first blower and a second blower. The first blower forces air across the first indoor heat exchanger, and the second blower forces air across the second indoor heat exchanger.

In some configurations of the climate-control system of any of the above paragraphs, the second blower forces air toward the first and second airflow paths.

In some configurations of the climate-control system of any of the above paragraphs, the first blower forces air from the return-air-inlet duct into the first airflow path, and the second blower forces air from the return-air-inlet duct away from the first airflow path and into the second airflow path.

In some configurations of the climate-control system of any of the above paragraphs, the first and second working-fluid-flow paths intersect each other at a first location and at a second location. The first location is disposed downstream of the outdoor heat exchanger and upstream of the first and second expansion devices. The second location is disposed upstream of the compressor and downstream of the first and second indoor heat exchangers.

In some configurations, the climate-control system of any of the above paragraphs includes a control module configured to control airflow through the first airflow path and through the second airflow path. The control module controls airflow through the first airflow path to control dehumidification of air provided to the supply-air-outlet duct. The control module controls airflow through the second airflow path to control sensible cooling of air provided to the supply-air-outlet duct.

In some configurations of the climate-control system of any of the above paragraphs, the control module is configured to control dehumidification and sensible cooling independently of each other.

In some configurations of the climate-control system of any of the above paragraphs, the air handler assembly includes a first blower and a second blower. The first blower forces air across the first indoor heat exchanger. The second blower forces air across the second indoor heat exchanger. The control module controls the first blower to control dehumidification of air provided to the supply-air-outlet duct. The control module controls the second blower to control sensible cooling of air provided to the supply-air-outlet duct.

In another form, the present disclosure provides a climate-control system that may include a compressor, an outdoor heat exchanger, a first working-fluid-flow path, a second working-fluid-flow path, a return-air-inlet duct, a first airflow path, a second airflow path, and a supply-air-outlet duct. The compressor is configured to compress a working fluid. The outdoor heat exchanger is in fluid communication with the compressor. The first working-fluid-flow path is in fluid communication with the outdoor heat exchanger. The first working-fluid-flow path may include a first expansion device and a first indoor heat exchanger. The second working-fluid-flow path is in fluid communication with the outdoor heat exchanger. The second working-fluid-flow path may include a second expansion device and a second indoor heat exchanger. The first airflow path may receive air from the return-air-inlet duct and may house the first indoor heat exchanger. The first airflow path may include an air-to-air heat exchanger. The second airflow path may receive air from the return-air-inlet duct. The supply-air-outlet duct may receive air from the first and second airflow paths. Air may flow through the first indoor heat exchanger in the first airflow path. Air that enters the supply-air-outlet duct from the second airflow path may have passed through the second indoor heat exchanger without flowing through the first indoor heat exchanger.

In some configurations of the climate-control system of the above paragraph, the second indoor heat exchanger is disposed in the second airflow path.

In some configurations of the climate-control system of either of the above paragraphs, the second indoor heat exchanger is disposed upstream of the first and second airflow paths. The first airflow path receives air that has passed through the second indoor heat exchanger.

In some configurations of the climate-control system of any of the above paragraphs, the air-to-air heat exchanger includes a duct upstream of the first indoor heat exchanger and another duct downstream of the first indoor heat exchanger. Heat is transferred between the air in the ducts.

In some configurations, the climate-control system of any of the above paragraphs includes a first blower and a second blower. The first blower forces air across the first indoor heat exchanger. The second blower forces air across the second indoor heat exchanger.

In some configurations of the climate-control system of any of the above paragraphs, the second blower forces air toward the first and second airflow paths.

In some configurations of the climate-control system of any of the above paragraphs, the first blower forces air from the return-air-inlet duct into the first airflow path, and the second blower forces air from the return-air-inlet duct away from the first airflow path and into the second airflow path.

In some configurations, the climate-control system of any of the above paragraphs includes a control module configured to control airflow through the first airflow path and through the second airflow path. The control module controls airflow through the first airflow path to control dehumidification of air provided to the supply-air-outlet duct. The control module controls airflow through the second airflow path to control sensible cooling of air provided to the supply-air-outlet duct. The control module is configured to control dehumidification and sensible cooling independently of each other.

In some configurations, the climate-control system of any of the above paragraphs includes a first blower and a second blower. The first blower forces air across the first indoor heat exchanger. The second blower forces air across the second indoor heat exchanger. The control module controls the first blower to control dehumidification of air provided to the supply-air-outlet duct. The control module controls the second blower to control sensible cooling of air provided to the supply-air-outlet duct.

In some configurations of the climate-control system of any of the above paragraphs, the first and second working-fluid-flow paths intersect each other at a first location and at a second location. The first location is disposed downstream of the outdoor heat exchanger and upstream of the first and second expansion devices. The second location is disposed upstream of the compressor and downstream of the first and second indoor heat exchangers.

In some configurations of the climate-control system of any of the above paragraphs, the second airflow path bypasses the first airflow path.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
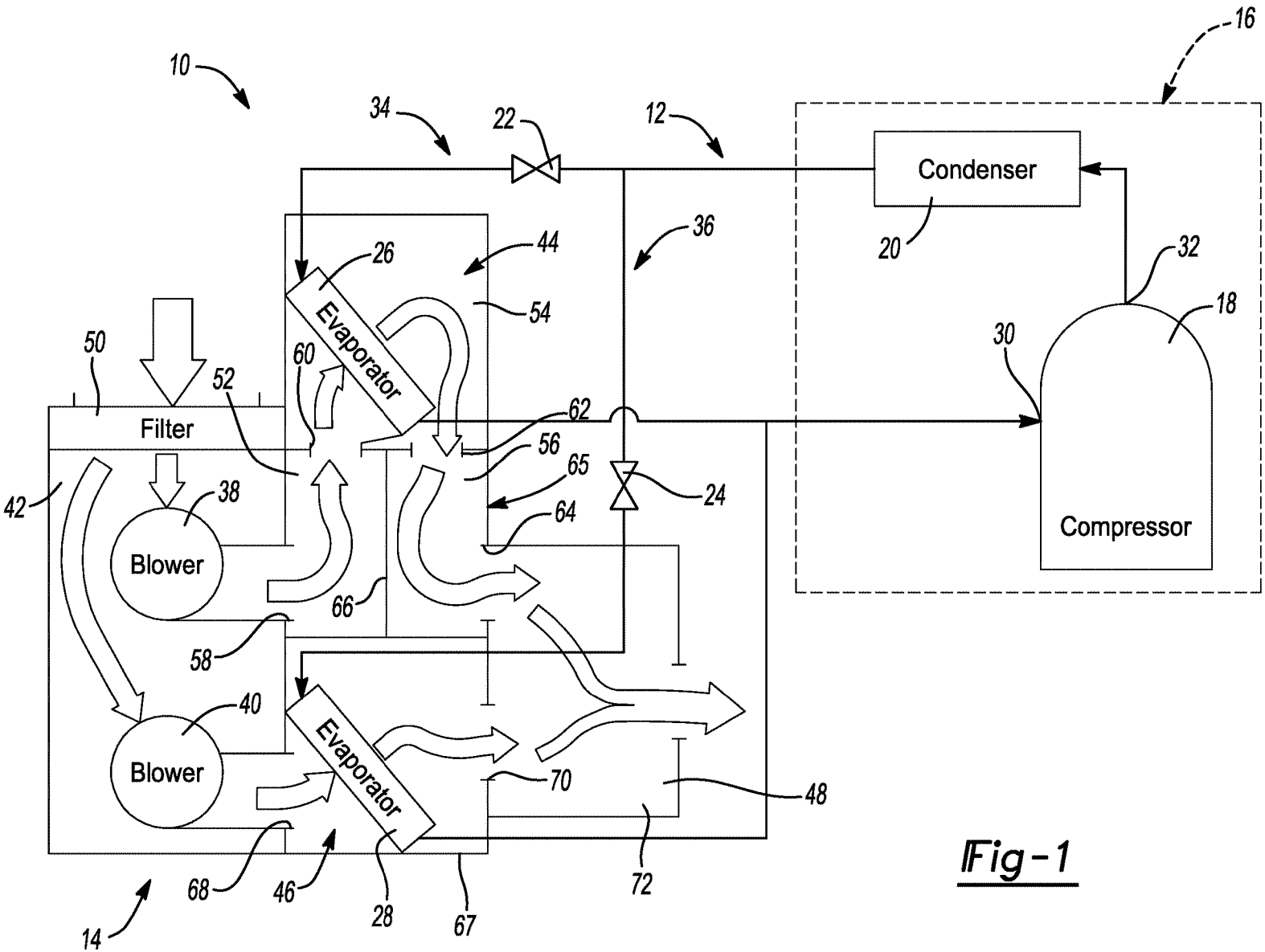
FIG. 1 is a schematic representation of a climate-control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided. As will be described in more detail below, the system 10 is operable to provide sensible cooling and latent cooling (dehumidification) simultaneously and independently of each other. The system 10 includes a vapor-compression circuit 12 and an air handler assembly 14. The air handler assembly 14 may be installed inside of a building or home, for example. The air handler assembly 14 may provide air cooled and/or dehumidified by the vapor-compression circuit 12 to a room or space within the building or home.

The vapor-compression circuit 12 may include a condensing unit 16 (including a compressor 18 and an outdoor heat exchanger (e.g., a condenser) 20), a first expansion device 22 (e.g., an expansion valve or capillary tube), a second expansion device 24 (e.g., an expansion valve or capillary tube), a first indoor heat exchanger (e.g., an evaporator) 26, and a second indoor heat exchanger (e.g., an evaporator) 28.

The compressor 18 may pump working fluid (refrigerant) through the vapor-compression circuit 12. The compressor 18 could be a scroll compressor (including first and second scrolls with intermeshing spiral wraps), for example, or any other type of compressor such as reciprocating (including a piston reciprocatingly received in a cylinder) or rotary vane compressor (including a rotor rotating within a cylinder), for example. The compressor 18 could be a variable-capacity compressor operable in full capacity mode and a reduced capacity mode. In some configurations, the compressor 18 could include additional or alternative capacity modulation capabilities (e.g., variable-speed motor, vapor injection, blocked suction, etc.). The compressor 18 may include a suction inlet 30 and a discharge outlet 32. The inlet 30 may receive working fluid from the first and second indoor heat exchangers 26, 28. The working fluid received through the inlet 30 may be compressed (by a compression mechanism) in the compressor 18 and may be discharged through the outlet 32.

The outdoor heat exchanger 20 may include a coil (or conduit) that receives working fluid discharged from the outlet 32 of the compressor 18. A fan (not shown) may force air across the coil of the outdoor heat exchanger 20 to facilitate heat transfer between outdoor ambient air and working fluid flowing through the coil of the outdoor heat exchanger 20. The condensing unit 16 (including the outdoor heat exchanger and the compressor 18) can be disposed outdoors (i.e., outside of a building, home, or other space to be cooled by the system 10).

The outdoor heat exchanger 20 provides working fluid to a first working-fluid-flow path 34 and a second working-fluid-flow path 36. The first working-fluid-flow path 34 may include the first expansion device 22 and the first indoor heat exchanger 26. The second working-fluid-flow path 36 may include the second expansion device 24 and the second indoor heat exchanger 28. The first and second expansion devices 22, 24 can be controlled (i.e., moved among a plurality of positions) to control amounts of working fluid that flow through the first and second working-fluid-flow paths 34, 36, respectively, from the outdoor heat exchanger 20. Working fluid flowing through the first working-fluid-flow path 34 may flow through the first expansion device 22 and then through the first indoor heat exchanger 26. Working fluid flowing through the second working-fluid-flow path 36 may flow through the second expansion device 24 and then through the second indoor heat exchanger 28. The first and second working-fluid-flow paths 34, 36 may converge with each other upstream of the suction inlet 30 of the compressor 18 such that the suction inlet 30 of the compressor receives working fluid from the first and second working-fluid-flow paths 34, 36.

The first and second indoor heat exchangers 26, 28 include coils (or conduits) that receive working fluid from the first and second expansion devices 22, 24, respectively. The first and second indoor heat exchangers 26, 28 are disposed within the air handler assembly 14. A first blower (or fan) 38 (disposed within the air handler assembly 14) may force air across the first indoor heat exchanger 26 to facilitate heat transfer between air in the air handler assembly 14 and working fluid in the first indoor heat exchanger 26. A second blower (or fan) 40 (disposed within the air handler assembly 14) may force air across the second indoor heat exchanger 28 to facilitate heat transfer between air in the air handler assembly 14 and working fluid in the second indoor heat exchanger 28.

In some configurations, the vapor-compression circuit 12 may include one or more reversing valve operable to switch operation of the circuit 12 between a cooling mode and a heating mode.

The air handler assembly 14 may include a return-air-inlet duct 42, the first and second blowers 38, 40, a first airflow path 44, a second airflow path 46, and a supply-air-outlet duct 48. The return-air-inlet duct 42 may receive air from one or more rooms or spaces of the building or home. An air filter 50 may be disposed within the return-air-inlet duct 42. The return-air-inlet duct 42 may be coupled with the first and second airflow paths 44, 46 such that a first portion of air in the return-air-inlet duct 42 may flow into the first airflow path 44 and a second portion of air in the return-air-inlet duct 42 may flow into the second airflow path 46. Air within the first airflow path 44 is fluidly isolated from air within the second airflow path 46. That is, the first and second airflow paths 44, 46 diverge from each other at the return-air-inlet duct 42 and converge with each other at the supply-air-outlet duct 48.

The first blower 38 may be disposed within the return-air-inlet duct 42 or within the first airflow path 44 and is operable to draw air from the return-air-inlet duct 42 through the first airflow path 44. The first blower 38 may include fan blades that are driven by an electric motor. The second blower 40 may be disposed within the return-air-inlet duct 42 or within the second airflow path 46 and is operable to draw air from the return-air-inlet duct 42 through the second airflow path 46. The second blower 40 may include fan blades that are driven by an electric motor.

The first airflow path 44 may include a first duct 52, a second duct 54, and a third duct 56. The first duct 52 may include an inlet 58 that receives air from the return-air-inlet duct 42 and an outlet 60 that provides air to the second duct 54. The first indoor heat exchanger 26 may be disposed within the second duct 54. The third duct 56 may include an inlet 62 that receives air from the second duct 54 and an outlet 64 that provides air to the supply-air-outlet duct 48. Air is cooled as it flows across the first indoor heat exchanger 26 in the second duct 54. One or more thin plates or walls 66 may separate the first duct 52 from the third duct 56 such that heat can be transferred from air flowing through the first duct 52 to air flowing through the third duct 56. In this manner, the first and third ducts 52, 56 form an air-to-air heat exchanger 65.

Figure 4:
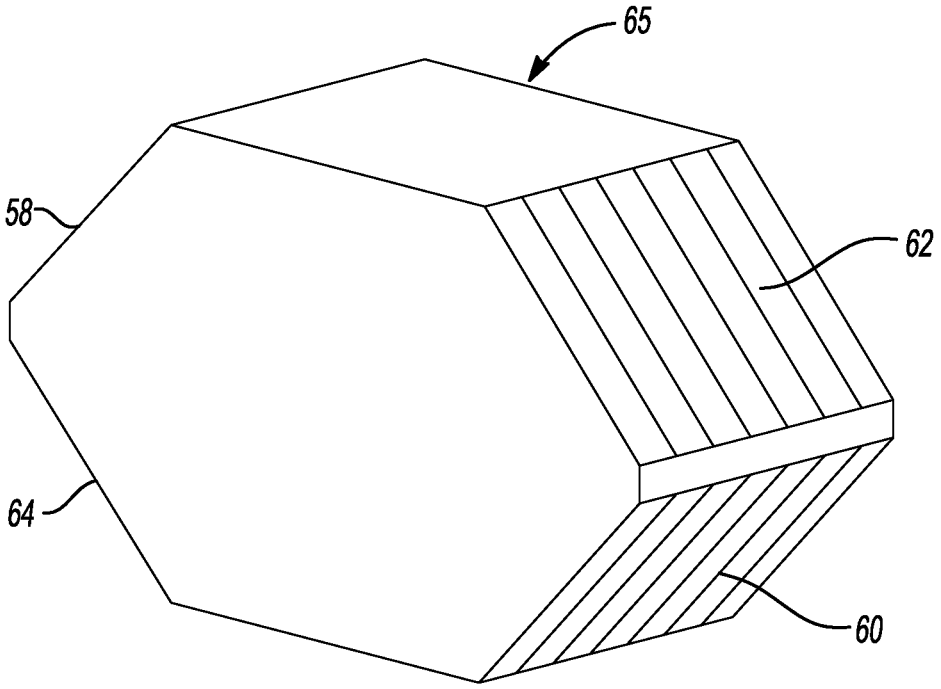
FIG. 4 is a perspective view of an air-to-air heat exchanger of the system of FIG. 1.
Figure 5:
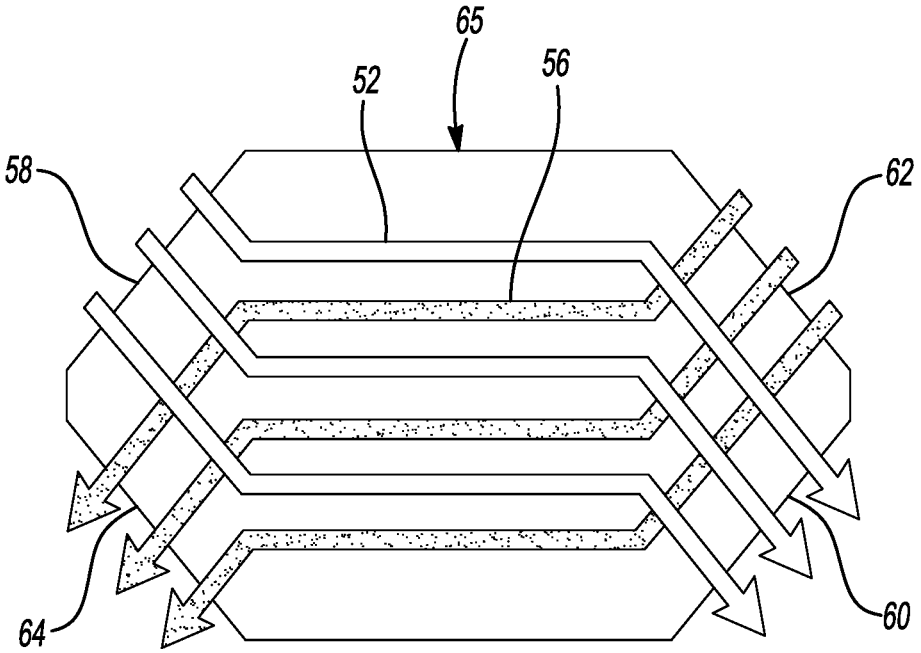
FIG. 5 is a schematic representation of the air-to-air heat exchanger.

FIGS. 4 and 5 depict an example of the air-to-air heat exchanger 65. As shown in FIG. 5, the air-to-air heat exchanger 65 may be configured such that air in the first duct 52 may flow crosswise or counter to airflow through the third duct 56. The first and third ducts 52, 56 may each include a plurality of layers of airflow paths separated by thin walls. In this manner, the heat is exchanged between air in the first duct 52 and air in the third duct 56 while preventing mixing of the air in the first duct 52 with air in the third duct 56. It will be appreciated that the air-to-air heat exchanger 65 could be configured in other ways.

The second airflow path 46 may include a duct 67 having an inlet 68 that receives air from the return-air-inlet duct 42 and an outlet 70 that provides air to the supply-air-outlet duct 48. The second indoor heat exchanger 28 may be disposed within the second airflow path 46 (e.g., within the duct 67). Air is cooled as it flows across the second indoor heat exchanger 28 in the duct 67.

The supply-air-outlet duct 48 may include a duct 72 that receives air from the first airflow path 44 and air from the second airflow path 46. Air from the first and second airflow paths 44, 46 may mix with each other in the supply-air-outlet duct 48. The duct 72 of the supply-air-outlet duct 48 may provide air to one or more rooms or spaces in the building or home.

A control module (or controller) 74 (FIG. 2) may be in communication with the first and second blowers 38, 40 and the first and second expansion devices 22, 24. The control module 74 may control operation of the blowers 38, 40 and expansion devices 22, 24 to cool the air within one or more rooms or spaces of the building or home and/or to dehumidify the air within the one or more rooms or spaces. The control module 74 may control the blowers 38, 40 and expansion devices 22, 24 based on temperature data (e.g., from a thermostat or temperature sensor) and humidity data (e.g., from a humidistat or humidity sensor) indicative of the temperature and relative humidity within the room or space of the building or home. In some configurations, the control module 74 may also control operation of the compressor 18 and the fan of the outdoor heat exchanger 20.

In some configurations, the air handler assembly 14 may include a single blower (instead of the first and second blowers 38, 40) that forces air through the return-air-inlet duct 42, the first and second airflow paths 44, 46 and through the supply-air-outlet duct 48. In such configurations, either or both of the first and second airflow paths 44, 46 could include a damper that can be adjusted to restrict or allow airflow through the first and second airflow paths 44, 46.

Figure 2:
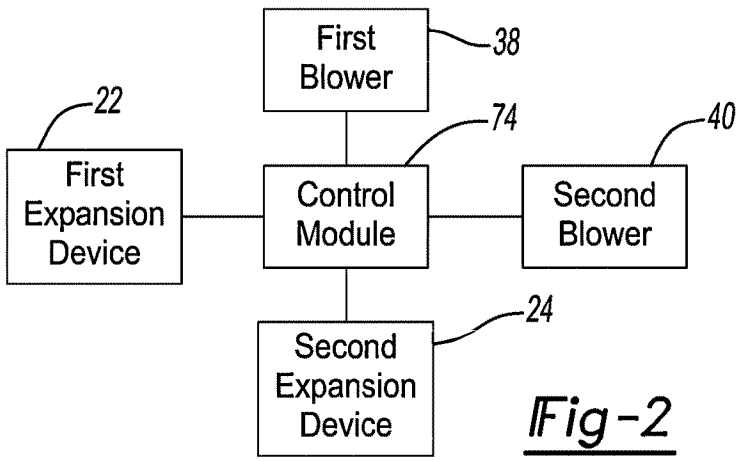
FIG. 2 is a schematic representation of a control module of the system of FIG. 1 in communication with other components of the system of FIG. 1.
Figure 3:
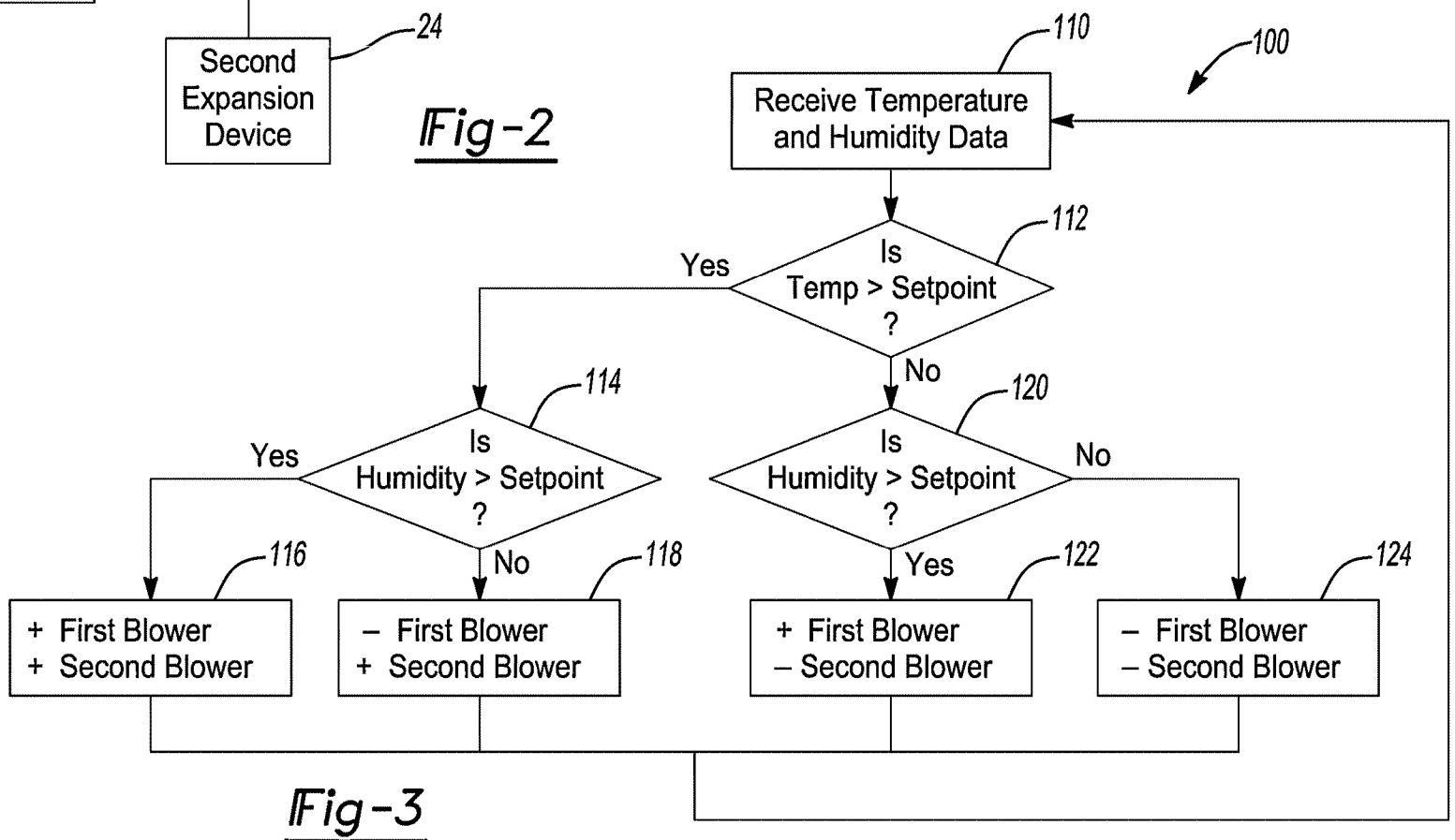
FIG. 3 is a flowchart illustrating a method of controlling the system of FIG. 1.

Referring now to FIGS. 1-3, operation of the system 10 will be described in detail. During operation of the compressor 18, the compressor 18 compresses working fluid and discharges compressed working fluid to the outdoor heat exchanger 20. In the outdoor heat exchanger 20, heat is transferred from the working fluid to the ambient outdoor air. From the outdoor heat exchanger 20, working fluid flows to the first and second working-fluid-flow paths 34, 36. The control module 74 may control the first and second expansion devices 22, 24 to independently control the amount of fluid flow through the first and second working-fluid-flow paths 34, 36. The temperature and pressure of the working fluid falls as it flows through first or second expansion device 22, 24. Working fluid from the first expansion device 22 flows through the first indoor heat exchanger 26, and working fluid from the second expansion device 24 flows through the second indoor heat exchanger 28. As described above, heat from air in the first airflow path 44 is transferred to working fluid flowing through the first indoor heat exchanger 26, and heat from air in the second airflow path 46 is transferred to working fluid flowing through the second indoor heat exchanger 28.

The system 10 is operable to independently control dehumidification (latent cooling) and sensible cooling. That is, the system 10 is operable to provide either: dehumidification with little or no sensible cooling, sensible cooling with little or no dehumidification, or sensible cooling and dehumidification.

As described above, air from the first duct 52 of the first airflow path 44 is cooled as it flows across the first indoor heat exchanger 26 in the second duct 54. The cooled air then flows into the third duct 56, where the air absorbs heat from the air in the first duct 52. The air exiting the first airflow path 44 (i.e., through the outlet 64 of the third duct 56) has low relative humidity. That is, the air flowing through the first airflow path 44 is dehumidified without significantly cooling the air. Furthermore, as described above, air in the second airflow path 46 is cooled as it flows across the second indoor heat exchanger 28. Therefore, air in the second airflow path 46 is significantly cooled without significantly dehumidifying the air.

The dehumidified air from the first airflow path 44 and the cooled air from the second airflow path 46 are provided to the supply-air-outlet duct 48 to provide a dehumidifying (latent cooling) effect and a sensible cooling effect to the room or space of the building or home. The control module 74 can separately and independently adjust the amount of dehumidification provided by the system 10 and the amount of sensible cooling provided by the system 10. Such separate and independent adjustment can be made by independently adjusting the positions of the first and second expansion devices 22, 24 and independently adjusting the speeds of the first and second blowers 38, 40.

Dehumidification can be increased by increasing airflow through the first airflow path 44 (i.e., by increasing the speed of the first blower 38) and/or by increasing working fluid flow through the first working-fluid-flow path 34 (i.e., opening the first expansion device 22 to increase working fluid flow through the first expansion device 22 and the first indoor heat exchanger 26). Dehumidification can be decreased by decreasing airflow through the first airflow path 44 (i.e., by slowing or stopping the first blower 38) and/or by decreasing working fluid flow through the first working-fluid-flow path 34 (i.e., closing the first expansion device 22 to decrease working fluid flow through the first expansion device 22 and the first indoor heat exchanger 26).

Sensible cooling can be increased by increasing airflow through the second airflow path 46 (i.e., by increasing the speed of the second blower 40) and/or by increasing working fluid flow through the second working-fluid-flow path 36 (i.e., opening the second expansion device 24 to increase working fluid flow through the second expansion device 24 and the second indoor heat exchanger 28). Sensible cooling can be decreased by decreasing airflow through the second airflow path 46 (i.e., by slowing or stopping the second blower 40) and/or by decreasing working fluid flow through the second working-fluid-flow path 36 (i.e., closing the second expansion device 24 to decrease working fluid flow through the second expansion device 24 and the second indoor heat exchanger 28).

FIG. 3 illustrates a method 100 by which the control module 74 can control the dehumidification and sensible cooling of the system 10. At step 110, the control module 74 may receive temperature and humidity data (e.g., from a temperature sensor or thermostat and from a humidity sensor or humidistat) for the room or space of the building or home. At step 112, the control module 74 may determine if the temperature in the room or space is greater than a predetermined setpoint temperature. If the control module 74 determines at step 112 that the temperature in the room or space is greater than the setpoint temperature, the control module 74 may determine (at step 114) if the humidity in the room or space is greater than a predetermined setpoint humidity. If the control module 74 determines at step 114 that the humidity in the room or space is greater than the setpoint humidity, the control module 74 may (at step 116) increase the speed of the first blower 38 and increase the speed of the second blower 40 (i.e., so that the system 10 will provide increased dehumidification and increased sensible cooling). If the control module 74 determines at step 114 that the humidity in the room or space is not greater than the setpoint humidity, the control module 74 may (at step 118) decrease the speed of the first blower 38 (or shut the first blower 38 off) and increase the speed of the second blower 40 (i.e., so that the system 10 will provide decreased dehumidification and increased sensible cooling).

If the control module 74 determines at step 112 that the temperature in the room or space is not greater than the setpoint temperature, the control module 74 may determine (at step 120) if the humidity in the room or space is greater than a predetermined setpoint humidity. If the control module 74 determines at step 120 that the humidity in the room or space is greater than the setpoint humidity, the control module 74 may (at step 122) increase the speed of the first blower 38 and decrease the speed of the second blower 40 (i.e., so that the system 10 will provide increased dehumidification and decreased sensible cooling). If the control module 74 determines at step 120 that the humidity in the room or space is not greater than the setpoint humidity, the control module 74 may (at step 124) decrease the speed of the first blower 38 (or shut the first blower 38 off) and decrease the speed of the second blower 40 (i.e., so that the system 10 will provide decreased dehumidification and decreased sensible cooling).

At any of steps 116, 118, 122, 124, the control module 74 may adjust the first and second expansion devices 22, 24 to control the flow of working fluid through the first and second indoor heat exchangers 26, 28 to maintain efficient operation of the vapor-compression circuit 12. For example, the control module 74 may control the first and second expansion devices 22, 24 to maintain predetermined superheat values at the outlets of the first and second indoor heat exchangers 26, 28. This would maintain a balance of airflow across the first and second indoor heat exchangers 26, 28 to working fluid flow through the first and second indoor heat exchangers 26, 28 to maintain effective and efficient operation of the system 10.

For example, the control module 74 could employ on/off, proportional, proportional and integral, PID (proportional-integral-derivative), or fuzzy logic to control the first and second blowers 38, 40 and the first and second expansion devices 22, 24.

After any of steps 116, 118, 122, 124, the process 100 may loop back to step 110 and the process 100 may repeat continuously or intermittently.

Figure 6:
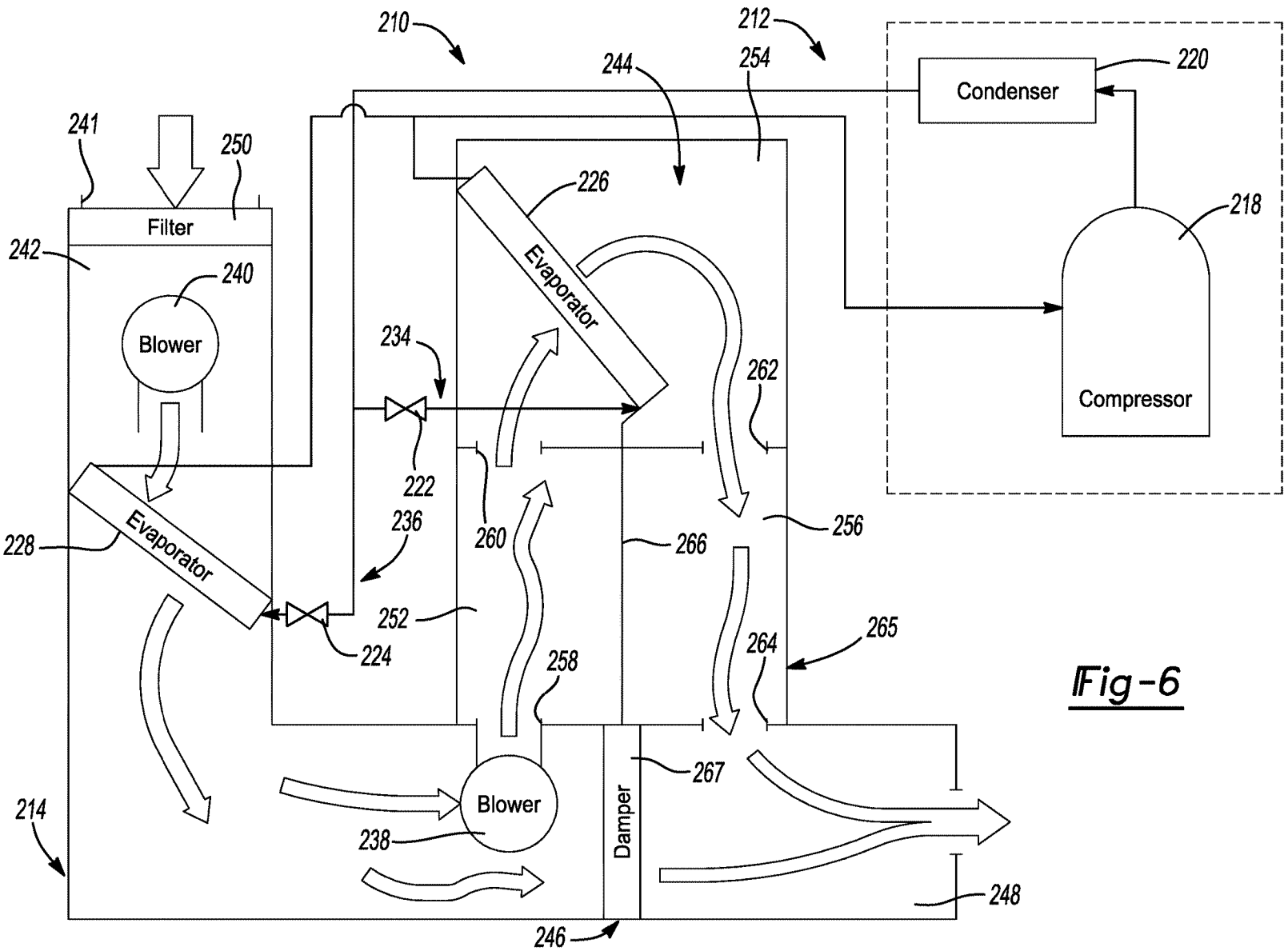
FIG. 6 is a schematic representation of another climate-control system according to the principles of the present disclosure.

With reference to FIG. 6, another climate-control system 210 is provided. Like the system 10 described above, the system 210 can independently control dehumidification (latent cooling) and sensible cooling of air provided to a space or room of a building or home. Like the system 10, the system 210 includes a vapor-compression circuit 212 and an air handler assembly 214.

The structure and function of the vapor-compression circuit 212 may be similar or identical to that of the vapor-compression circuit 12 described above. Therefore, similar features may not be described again in detail. Briefly, the vapor-compression circuit 212 may include a compressor 218, an outdoor heat exchanger (e.g., a condenser) 220, a first expansion device (e.g., an expansion valve or capillary tube) 222, a first indoor heat exchanger (e.g., an evaporator) 226, a second expansion device (e.g., an expansion valve or capillary tube) 224, and a second indoor heat exchanger (e.g., an evaporator) 228. The structure and function of the compressor 218, heat exchangers 220, 226, 228, and expansion devices 222, 224 may be similar or identical to that of the compressor 18, heat exchangers 20, 26, 28, and expansion devices 22, 24 described above. The first expansion device 222 and first indoor heat exchanger 226 are disposed along a first working-fluid-flow path 234, and the second expansion device 224 and second indoor heat exchanger 228 are disposed along a second working-fluid-flow path 236.

The air handler assembly 214 may include a return-air-inlet duct 242, a first blower 238, a second blower 240, a first airflow path 244, a second airflow path 246, and a supply-air-outlet duct 248. The return-air-inlet duct 242 may receive air from one or more rooms or spaces of the building or home. An air filter 250 may be disposed within the return-air-inlet duct 242. The return-air-inlet duct 242 may be coupled with the first and second airflow paths 244, 246 such that a first portion of air in the return-air-inlet duct 242 may flow into the first airflow path 244 and a second portion of air in the return-air-inlet duct 242 may flow into the second airflow path 246. The second airflow path 246 bypasses the first airflow path 244. That is, the first and second airflow paths 244, 246 diverge from each other at the return-air-inlet duct 242 and converge with each other at the supply-air-outlet duct 248.

The second blower 240 and the second indoor heat exchanger 228 may be disposed within the return-air-inlet duct 242 upstream of the first and second airflow paths 244, 246. That is, air that flows through the second blower 240 and the second indoor heat exchanger 228 before flowing into either of the first and second airflow paths 244, 246.

The first airflow path 244 may include a first duct 252, a second duct 254, and a third duct 256. The first duct 252 may include an inlet 258 that receives air from the return-air-inlet duct 242 (i.e., downstream of the second blower 240 and second indoor heat exchanger 228) and an outlet 260 that provides air to the second duct 254. The first indoor heat exchanger 226 may be disposed within the second duct 254. The third duct 256 may include an inlet 262 that receives air from the second duct 254 and an outlet 264 that provides air to the supply-air-outlet duct 248. Air is cooled as it flows across the first indoor heat exchanger 226 in the second duct 254. One or more thin plates or walls 266 may separate the first duct 252 from the third duct 256 such that heat can be transferred from air flowing through the first duct 252 to air flowing through the third duct 256. In this manner, the first and third ducts 252, 256 form an air-to-air heat exchanger 265. The air-to-air heat exchanger 265 could be similar or identical to the air-to-air heat exchanger 65 described above. The first blower 238 may be disposed at or near the inlet 258 of the first duct 252 and is operable to force through the first airflow path 244.

The second airflow path 246 is a bypass that allows air from the return-air-inlet duct 242 to bypass the first airflow path 244. The second airflow path 246 may include a damper (or valve) 267 that can be selectively opened (to allow airflow through the second airflow path 246) and closed (to prevent airflow through the second airflow path 246).

In some configurations, the air handler assembly 214 may include a single blower (instead of the first and second blowers 238, 240) that forces air through the return-air-inlet duct 242, the first and second airflow paths 244, 246 and through the supply-air-outlet duct 248.

With continued reference to FIG. 6, operation of the system 210 will be described in detail. During operation of the compressor 218, the compressor 218 compresses working fluid and discharges compressed working fluid to the outdoor heat exchanger 220. In the outdoor heat exchanger 220, heat is transferred from the working fluid to the ambient outdoor air. From the outdoor heat exchanger 220, working fluid flows to the first and second working-fluid-flow paths 234, 236. A control module (similar or identical to the control module 74 described above) may control the first and second expansion devices 222, 224 to independently control the amount of fluid flow through the first and second working-fluid-flow paths 234, 236. The temperature and pressure of the working fluid falls as it flows through first or second expansion device 222, 224. Working fluid from the first expansion device 222 flows through the first indoor heat exchanger 226 and working fluid from the second expansion device 224 flows through the second indoor heat exchanger 228. Heat from air in the first airflow path 244 is transferred to working fluid flowing through the first indoor heat exchanger 226, and heat from air in the return-air-inlet duct 242 (upstream of the first and second airflow paths 244, 246) is transferred to working fluid flowing through the second indoor heat exchanger 28.

The system 210 is operable to independently control dehumidification (latent cooling) and sensible cooling. That is, the system 210 is operable to provide either: dehumidification with little or no sensible cooling, sensible cooling with little or no dehumidification, or sensible cooling and dehumidification.

Air enters the air handler assembly 214 through an inlet 241 of the return-air-inlet duct 242. The second blower 240 may force the air from the inlet 241 across the second indoor heat exchanger 228, where heat from the air is transferred to working fluid in the second indoor heat exchanger 228. From the second indoor heat exchanger 228, the air flows toward the first and second airflow paths 244, 246. The first blower 238 may force at least a portion of the air from the second indoor heat exchanger 228 into the first airflow path 244, and if the damper 267 is at least partially open, the damper 267 allows at least another portion of the air from the second indoor heat exchanger 228 into the second airflow path 246. Closing the damper 267 prevents airflow through the second airflow path 246. Shutting down the first blower 238 may reduce or prevent airflow through the first airflow path 244.

Air from the first duct 252 of the first airflow path 244 is cooled as it flows across the first indoor heat exchanger 226 in the second duct 254. The cooled air then flows into the third duct 256, where the air absorbs heat from the air in the first duct 252. The air exiting the first airflow path 244 (i.e., through the outlet 264 of the third duct 256) has low relative humidity. That is, the air flowing through the first airflow path 244 is dehumidified without significantly cooling the air (i.e., the air flowing through the first airflow path 244 is cooled somewhat, but not enough to significantly cool the room or space of the building or home). Furthermore, as described above, air in the second airflow path 246 has been cooled by the second indoor heat exchanger 228. Therefore, air in the second airflow path 246 is significantly cooled without significantly dehumidifying the air.

The dehumidified air from the first airflow path 244 and the cooled air from the second airflow path 246 are provided to the supply-air-outlet duct 248 to provide a dehumidifying (latent cooling) effect and a sensible cooling effect to the room or space of the building or home. The control module can separately and independently adjust the amount of dehumidification provided by the system 210 and the amount of sensible cooling provided by the system 210. Such separate and independent adjustment can be made by independently adjusting the positions of the first and second expansion devices 222, 224 and independently adjusting the speeds of the first and second blowers 238, 240.

Dehumidification can be increased by increasing airflow through the first airflow path 244 (i.e., by increasing the speed of the first blower 238) and/or by increasing working fluid flow through the first working-fluid-flow path 234 (i.e., opening the first expansion device 222 to increase working fluid flow through the first expansion device 222 and the first indoor heat exchanger 226). Dehumidification can be decreased by decreasing airflow through the first airflow path 244 (i.e., by slowing or stopping the first blower 238) and/or by decreasing working fluid flow through the first working-fluid-flow path 234 (i.e., closing the first expansion device 222 to decrease working fluid flow through the first expansion device 222 and the first indoor heat exchanger 226).

Sensible cooling can be increased by increasing airflow through the second airflow path 246 (i.e., by increasing the speed of the second blower 240 and/or moving the damper 267 toward a fully open position) and/or by increasing working fluid flow through the second working-fluid-flow path 236 (i.e., opening the second expansion device 224 to increase working fluid flow through the second expansion device 224 and the second indoor heat exchanger 228). Sensible cooling can be decreased by decreasing airflow through the second airflow path 246 (i.e., by slowing or stopping the second blower 240 and/or moving the damper 267 toward a fully closed position) and/or by decreasing working fluid flow through the second working-fluid-flow path 236 (i.e., closing the second expansion device 224 to decrease working fluid flow through the second expansion device 224 and the second indoor heat exchanger 228).

As described above, the control module of the system 210 is configured to control the blowers 238, 240 and expansion devices 222, 224 to independently control sensible cooling and latent cooling. For example, the control module of the system 210 can execute the method 100 shown in FIG. 3 and described above.

The independent control of the dehumidification and sensible cooling described above with respect to the climate-control systems 10, 210 allows for more customized climate control. For example, when weather conditions in a given location include high heat and low humidity, there may be a desire for sensible cooling within a building or home and less of a desire (or no desire) for dehumidification inside of the building or home. Under such conditions, the climate-control system 10, 210 is able to provide sensible cooling with little or no dehumidification. As another example, when weather conditions in a given location include high humidity and milder temperatures, there may be a desire for dehumidification within a building or home and less of a desire (or no desire) for sensible cooling inside of the building or home. Under such conditions, the climate-control system 10, 210 is able to provide dehumidification with little or no sensible cooling. As another example, when weather conditions in a given location include high humidity and high temperatures, there may be a desire for dehumidification and sensible cooling within a building or home. Under such conditions, the climate-control system 10, 210 is able to provide dehumidification and sensible cooling. Accordingly, the climate-control system 10, 210 is able to provide customized latent and sensible cooling to provide improved comfort without unnecessary power consumption.

In some configurations, the vapor-compression circuit 12, 212 may include one or more reversing valve operable to switch operation of the circuit 12, 212 between a cooling mode and a heating mode. The climate-control system 10, 210 may be a heat-pump system, an air conditioning system, or a refrigeration system, for example.

In this application, including the definitions below, the term "module" or "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate-control system comprising:

a vapor-compression circuit including:

a compressor configured to circulate a working fluid through the vapor-compression circuit;

an outdoor heat exchanger in fluid communication with the compressor;

a first working-fluid-flow path in fluid communication with the outdoor heat exchanger, the first working-fluid-flow path including a first expansion device and a first indoor heat exchanger; and a second working-fluid-flow path in fluid communication with the outdoor heat exchanger, the second working-fluid-flow path including a second expansion device and a second indoor heat exchanger; and an air handler assembly in which the first and second indoor heat exchangers are disposed, the air handler assembly including:

a return-air-inlet duct;

a first airflow path receiving air from the return-air-inlet duct and housing the first indoor heat exchanger;

a second airflow path receiving air from the return-air-inlet duct;

a supply-air-outlet duct receiving air from the first and second airflow paths;

a first blower forcing air through the first airflow path;

a second blower forcing air through the second airflow path; and a control module configured to receive a measured temperature and a measured humidity and configured to control operation of the first and second blowers and the first and second expansion devices based on the measured temperature and the measured humidity to independently and separately control dehumidification and sensible cooling, wherein in response to the measured humidity being greater than a humidity setpoint and regardless of whether the measured temperature is greater than the temperature setpoint, the control module is configured to increase dehumidification by one or both of: (a) increasing a speed of the first blower, and (b) increasing working fluid flow through the first working fluid flow path, wherein in response to the measured temperature being greater than a temperature setpoint and regardless of whether the measured humidity is greater than the humidity setpoint, the control module is configured to increase sensible cooling by one or both of: (a) increasing a speed of the second blower, and (b) increasing working fluid flow through the second working fluid flow path, wherein in response to the measured humidity being less than the humidity setpoint and regardless of whether the measured temperature is less than the temperature setpoint, the control module is configured to decrease dehumidification by one or both of: (a) decreasing a speed of the first blower, and (b) decreasing working fluid flow through the first working fluid flow path, and wherein in response to the measured temperature being less than the temperature setpoint and regardless of whether the measured humidity is less than the humidity setpoint, the control module is configured to decrease sensible cooling by one or both of: (a) decreasing a speed of the second blower, and (b) decreasing working fluid flow through the second working fluid flow path.

2. The climate-control system of claim 1, wherein air flows through the first indoor heat exchanger in the first airflow path, and wherein air that enters the supply-air-outlet duct from the second airflow path will have passed through the second indoor heat exchanger without flowing through the first indoor heat exchanger.

3. The climate-control system of claim 2, wherein the second airflow path bypasses the first airflow path, and wherein the second indoor heat exchanger is disposed in the second airflow path.

4. The climate-control system of claim 2, wherein the second airflow path bypasses the first airflow path, wherein the second indoor heat exchanger is disposed upstream of the first and second airflow paths, and wherein the first airflow path receives air that has passed through the second indoor heat exchanger.

5. The climate-control system of claim 4, wherein the second airflow path includes a damper that controls airflow through the second airflow path.

6. The climate-control system of claim 1, wherein the first airflow path includes an air-to-air heat exchanger.

7. The climate-control system of claim 6, wherein the air-to-air heat exchanger includes a duct upstream of the first indoor heat exchanger and another duct downstream of the first indoor heat exchanger, and wherein heat is transferred between the air in the ducts.

8. The climate-control system of claim 1, the first blower forces air across the first indoor heat exchanger, and wherein the second blower forces air across the second indoor heat exchanger.

9. The climate-control system of claim 8, wherein the second blower forces air toward the first and second airflow paths.

10. The climate-control system of claim 8, wherein the first blower forces air from the return-air-inlet duct into the first airflow path, and wherein the second blower forces air from the return-air-inlet duct away from the first airflow path and into the second airflow path.

11. A climate-control system comprising:

a compressor configured to compress a working fluid;

an outdoor heat exchanger in fluid communication with the compressor;

a first working-fluid-flow path in fluid communication with the outdoor heat exchanger, the first working-fluid-flow path including a first expansion device and a first indoor heat exchanger;

a second working-fluid-flow path in fluid communication with the outdoor heat exchanger, the second working-fluid-flow path including a second expansion device and a second indoor heat exchanger;

a return-air-inlet duct;

a first airflow path receiving air from the return-air-inlet duct and housing the first indoor heat exchanger, wherein the first airflow path includes an air-to-air heat exchanger;

a second airflow path receiving air from the return-air-inlet duct;

a supply-air-outlet duct receiving air from the first and second airflow paths;

a first blower forcing air through the first airflow path;

a second blower forcing air through the second airflow path; and a control module configured to receive a measured temperature and a measured humidity and configured to control operation of the first and second blowers and the first and second expansion devices based on the measured temperature and the measured humidity to independently and separately control dehumidification and sensible cooling, wherein in response to the measured humidity being greater than a humidity setpoint and regardless of whether the measured temperature is greater than the temperature setpoint, the control module is configured to increase dehumidification by one or both of: (a) increasing a speed of the first blower, and (b) increasing working fluid flow through the first working fluid flow path, wherein in response to the measured temperature being greater than a temperature setpoint and regardless of whether the measured humidity is greater than the humidity setpoint, the control module is configured to increase sensible cooling by one or both of: (a) increasing a speed of the second blower, and (b) increasing working fluid flow through the second working fluid flow path, wherein in response to the measured humidity being less than the humidity setpoint and regardless of whether the measured temperature is less than the temperature setpoint, the control module is configured to decrease dehumidification by one or both of: (a) decreasing a speed of the first blower, and (b) decreasing working fluid flow through the first working fluid flow path, and wherein in response to the measured temperature being less than the temperature setpoint and regardless of whether the measured humidity is less than the humidity setpoint, the control module is configured to decrease sensible cooling by one or both of: (a) decreasing a speed of the second blower, and (b) decreasing working fluid flow through the second working fluid flow path, and wherein air flows through the first indoor heat exchanger in the first airflow path, and wherein at least a portion of air that enters the supply-air-outlet duct from the second airflow path will have passed through the second indoor heat exchanger without flowing through the first indoor heat exchanger.

12. The climate-control system of claim 11, wherein the second indoor heat exchanger is disposed in the second airflow path.

13. The climate-control system of claim 11, wherein the second indoor heat exchanger is disposed upstream of the first and second airflow paths, and wherein the first airflow path receives air that has passed through the second indoor heat exchanger.

14. The climate-control system of claim 11, wherein the air-to-air heat exchanger includes a duct upstream of the first indoor heat exchanger and another duct downstream of the first indoor heat exchanger, and wherein heat is transferred between the air in the ducts.

15. The climate-control system of claim 11, wherein the second blower forces air toward the first and second airflow paths.

16. The climate-control system of claim 11, wherein the first blower forces air from the return-air-inlet duct into the first airflow path, and wherein the second blower forces air from the return-air-inlet duct away from the first airflow path and into the second airflow path.

* * * * *